US011009020B2

(12) United States Patent
Velásquez-García et al.

(10) Patent No.: US 11,009,020 B2
(45) Date of Patent: May 18, 2021

(54) VACUUM PUMPS AND METHODS OF MANUFACTURING THE SAME

(71) Applicants: Massachusetts Institute of Technology, Cambridge, MA (US); Edwards Vacuum, Sanborn, NY (US)

(72) Inventors: Luis Fernando Velásquez-García, Newton, MA (US); Anthony Park Taylor, Boston, MA (US)

(73) Assignees: Massachusetts Institute of Technology, Cambridge, MA (US); Edwards Vacuum, Sanborn, NY (US)

( * ) Notice: Subject to any disclaimer, the term of this patent is extended or adjusted under 35 U.S.C. 154(b) by 79 days.

(21) Appl. No.: 16/347,781

(22) PCT Filed: Nov. 28, 2017

(86) PCT No.: PCT/US2017/063545
§ 371 (c)(1),
(2) Date: May 6, 2019

(87) PCT Pub. No.: WO2018/098505
PCT Pub. Date: May 31, 2018

(65) Prior Publication Data

US 2019/0345926 A1 Nov. 14, 2019

Related U.S. Application Data

(60) Provisional application No. 62/426,833, filed on Nov. 28, 2016.

(51) Int. Cl.
*F04B 43/04* (2006.01)
*F04B 7/00* (2006.01)
(Continued)

(52) U.S. Cl.
CPC ..... *F04B 43/043* (2013.01); *F04B 7/0076* (2013.01); *F04B 7/02* (2013.01);
(Continued)

(58) Field of Classification Search
CPC ..... F04B 7/0076; F04B 43/06; F04B 45/04; F04B 45/047; F04B 45/053; F04B 49/06
See application file for complete search history.

(56) References Cited

U.S. PATENT DOCUMENTS 2,189,526 A 2/1940 Babitch
3,391,963 A 7/1968 Weeks
(Continued)

FOREIGN PATENT DOCUMENTS

DE 202010002145 U1 9/2011

OTHER PUBLICATIONS

International Search Report of PCT/US17/63545, US as ISA, dated Mar. 7, 2018.
(Continued)

*Primary Examiner* — Patrick Hamo
(74) *Attorney, Agent, or Firm* — Nutter McClennen & Fish LLP

(57) ABSTRACT

Techniques for manufacturing miniaturized diaphragm pumps using additive manufacturing techniques, such as polyjet printing, are provided, as are the pumps and systems that result from using such techniques to produce the pumps. The provided pumps include a compression chamber that has a first surface, a second opposed surface, and a conical outer wall that extends between the first surface and the second surface and that has a bowed configuration in which the outer wall has a generally concave shape. A diaphragm is disposed proximate to the compression chamber, and the pump also includes one or more valves that control the flow of fluid between the compression chamber and one more
(Continued)

fluid ports. Fluid can be selectively vacuumed into and exhausted out of the compression chambers. Various manufacturing techniques for fabricating the pumps are also provided.

20 Claims, 4 Drawing Sheets

(51) Int. Cl.

| | |
|---|---|
| ***F04B 43/06*** | (2006.01) |
| ***F04B 7/02*** | (2006.01) |
| ***F04B 45/047*** | (2006.01) |
| ***F04B 45/053*** | (2006.01) |
| ***F04B 49/06*** | (2006.01) |

(52) U.S. Cl.
CPC ..... *F04B 43/06* (2013.01); *F04B 45/047* (2013.01); *F04B 45/053* (2013.01); *F04B 49/06* (2013.01)

(56) References Cited

U.S. PATENT DOCUMENTS

| | | | | |
|---|---|---|---|---|
| 7,819,642 | B2 * | 10/2010 | Zabar | F04B 45/043 417/413.1 |
| 2003/0123997 | A1 | 7/2003 | Hauser | |
| 2011/0280755 | A1 * | 11/2011 | Wackerle | F04B 23/06 417/559 |
| 2012/0037567 | A1 * | 2/2012 | Knight | G01N 30/42 210/657 |
| 2012/0189468 | A1 * | 7/2012 | Becker | F04B 19/006 417/253 |
| 2013/0236335 | A1 * | 9/2013 | Nelson | F04B 43/0009 417/394 |
| 2015/0337832 | A1 | 11/2015 | Cai et al. | |

OTHER PUBLICATIONS

[No Author Listed] Formlabs FLFLGR02 Material Properties, https://formlabs.com/media/upload/Flexible-DataSheet_D93ECMO.pdf.
[No Author Listed] NinjaFlex, https://ninjatek.com/products/filaments/ninjaflex/.
[No Author Listed] Polyjet, https://www.stratasysdirect.com/solutions/polyjet/.
[No Author Listed] Polyjet Flex & Polyjet Over-Mold Materials Specifications, https://www.stratasysdirect.com/wpcontent/themes/stratasysdirect/files/materialdatasheets/polyjet/PolyJet_Flex_PolyJet_Overmold_Material_Specifications.pdf.
[No Author Listed] Polyjet Materials Properties, http://global72.stratasys.com/~/media/Main/Files/Material_Spec_Sheets/MSS_PJ_PJMaterialsDataSheet.ashx.
[No Author Listed] TCS Micropumps D3K Series Miniature Diaphragm Gas/Air Pump—Data Sheet, http://www.micropumps.co.uk/DATA/pdf/DS27%20-%20D3k%20Data%20Sheet%20rev%201.pdf.
Au et al., "3D-printed microfluidics," Angewandte Chemie, International Edition, vol. 55, Issue 12, pp. 3862-3881, 2016.
Besharatian et al., "Valve-only pumping in mechanical gas micropumps," 2013 Transducers & Eurosensors XXVII: The 17th International Conference on Solid-State Sensors, Actuators and Microsystems, Jun. 16-20, 2013.
Carrozza et al., "A piezoelectric-driven stereolithography-fabricated micropump," Journal of Micromechanics and Microengineering, vol. 5, No. 2, pp. 177-179, 1995.
Chakraborty et al., "MEMS microvalve for space applications," Sens. Actuators A, Phys., vol. 83, Nos. 1-3, pp. 188-193, 2000.
Conner et al., "Making sense of 3-D printing: Creating a map of additive manufacturing products and services," Additive Manufacturing, vols. 1-4, pp. 64-76, Oct. 2014.
Critchley et al., "The preparation of auxetic foams by three-dimensional printing and their characteristics," Advanced Engineering Materials, vol. 15, Issue 10, pp. 980-985, Oct. 2013.
Dalaq et al., "Mechanical properties of 3D printed interpenetrating phase composites with novel architectured 3D solid-sheet reinforcements," Composites: Part A, vol. 84, pp. 266-280, May 2016.
Frey et al., "Modelling and experimental characterization of diaphragm pumps and tubing," 24th International Congress of Theoretical and Applied Mechanics, Montreal, QC, Canada, Aug. 21-26, 2016.
Garcia-Lopez et al., "3-D printed multiplexed electrospinning sources for large-scale production of aligned nanofiber mats with small diameter spread," Nanotechnology, vol. 28, No. 42, Sep. 2017.
Gong et al., "High density 3D printed microfluidic valves, pumps, and multiplexers," Lab Chip, vol. 16, No. 13, pp. 2450-2458, 2016.
Huber et al., "3D print of polymer bonded rare-earth magnets, and 3D magnetic field scanning with an end-user 3D printer," Applied Physics Letters, vol. 109, No. 16, p. 162401, 2016.
Jerman, H, "Electrically activated normally closed diaphragm valves," Journal of Micromechanics and Microengineering, vol. 4, No. 4, p. 210-215, 1994.
Kim et al., "A fully integrated high-efficiency peristaltic 18-stage gas micropump with active microvalves," 2007 IEEE 20th International Conference on Microelectromechanical Systems (MEMS), Jan. 21-25, 2007.
Laser et al., "A review of micropumps," Journal of Micromechanics and Microengineering, vol. 14, No. 6, pp. R35-R64, 2004.
Malcolm et al., "Miniature mass spectrometer systems based on a microengineered quadrupole filter," Analytical Chemistry, vol. 82, No. 5, pp. 1751-1758, 2010.
Moore et al., "Fatigue characterization of 3D printed elastomer material," Proc. 23rd Ann. Int. Solid Freeform Fabrication (SFF) Symp. Austin, TX, pp. 641-655, 2012.
Nagarajan et al., "Cavity-based medium resolution spectroscopy (CBMRS) in the THz: A bridge between high- and low-resolution techniques for sensor and spectroscopy applications," IEEE Transactions on Terahertz Science and Technology, vol. 7, Issue 3, pp. 233-243, May 2017.
Oh et al., "A review of microvalves," Journal of Micromechanics and Microengineering, vol. 16, No. 5, pp. R13-R39, 2006.
Olvera-Trejo et al., "Additively manufactured MEMS multiplexed coaxial electrospray sources for the high-throughput, uniform generation of core-shell microparticles," Lab Chip, vol. 16, No. 21, pp. 4121-4132, 2016.
Peacock, R.N., "Practical selection of elastomer materials for vacuum seals," Journal of Vacuum Science and Technology, vol. 17, No. 1, pp. 330-336, 1980.
Roberts, D.C., "Design, modeling, fabrication and testing of a piezoelectric microvalve for high pressure, high frequency hydraulic applications," Massachusetts Institute of Technology, Department of Mechanical Engineering, 2002.
Scheibert et al., "The role of fingerprints in the coding of tactile information probed with a biomimetic sensor," Science, vol. 323, No. 5920, pp. 1503-1506, 2009.
Sharma, V, "MEMS micropump for a micro gas analyzer," Thesis (Ph. D.) Massachusetts Institute of Technology, Department of Electrical Engineering and Computer Science, 2009.
Simoes-Moreira, J.R., "Fundamentals of thermodynamics applied to thermal power plants," Thermal Power Plant Performance Analysis, New York, NY, USA: Springer, pp. 7-39, 2012.
Syms et al., "MEMS mass spectrometers: The next wave of miniaturization," Journal of Micromechanics and Microengineering, vol. 26, No. 2, p. 023001, 2016.
Taylor et al., "3-D printed miniaturized diaphragm vacuum pump," 2017 IEEE 30th International Conference on Microelectromechanical Systems (MEMS), Jan. 22-26, 2017, Las Vegas, NV, USA.
Taylor et al., "Electrospray-printed nanostructured graphene oxide gas sensors," Nanotechnology, vol. 26, No. 50, p. 505301, 2015.
Taylor et al., "Miniaturized Diaphragm Vacuum Pump by Multi-Material Additive Manufacturing," Journal of Microelectromechanical Systems, vol. 26, Issue 6, pp. 1316-1326, 2017.

(56) References Cited

OTHER PUBLICATIONS

Vaezi et al., "A review on 3D micro-additive manufacturing technologies," The International Journal of Advanced Manufacturing Technology, vol. 67, Issues 5-8, pp. 1721-1754, Jul. 2013.
Velásquez-Garcia, L.F., "SLA 3D-printed arrays of miniaturized, internally-fed, polymer electrospray emitters," Journal of Microelectromechanical Systems, vol. 24, No. 6, pp. 2117-2127, Dec. 2015.
Vu et al., "Characterization of multi-material interfaces in polyjet additive manufacturing," Proc. 26th Ann. Int. Solid Freeform Fabrication (SFF) Symp. Austin, TX, pp. 959-982, 2015.
Waheed et al., "3D Printed microfluidic devices: enablers and barriers," Lab Chip, vol. 16, No. 11, pp. 1993-2013, Jun. 2016.
Yobas et al., "A novel bulk micromachined electrostatic microvalve with a curved-compliant structure applicable for a oneumatic tactile display," Journal of Microelectromechanical Systems, vol. 10, Issue 2, pp. 187-196, Jun. 2001.
Young et al., "Roark's Formulas for Stress and Strain," Chapter 5, 7th Edition, New York, NY, USA, McGraw-Hill, 2002.
Zhou et al., "A single-stage micromachined vacuum pump achieving 164 Torr absolute pressure," 2011 IEEE 24th International Conference on Micro Electro Mechanical Systems, Jan. 23-27, 2011, Cancun, Mexico.
[No Author Listed] Gardner Denver Thomas Mini Diaphragm Pumps Models 16xx, https://www.gd-thomas.com/assets/0/121/142/134/336/79a05467-b45d-4512-95dc-f97aa87fec5c.pdf.
[No Author Listed] http://usglobalimages.stratasys.com/Main/Files/Material_Spec_Sheets/MSS_PJ_PJMaterialsDataSheet.pdf.
[No Author Listed] Nitto Diaphragm Pump Lk053_DP0110T, https://www.nitto-kohki.co.jp/e/prd/new/pdf/Lk053_DP0110T.pdf.
Jousten, K, "Handbook of Vacuum Technology," 1st Edition, Hoboken, NJ, USA, Wiley, 2008.
Lifton et al., "Options for additive rapid prototyping methods (3D printing) in MEMS technology," Rapid Prototyping Journal, vol. 20, No. 5, pp. 403-412, 2014.
O'Hanlon, J.F., "A User's Guide to Vacuum Technology," 3rd Edition, p. 360, Hoboken, NJ, USA: Wiley, 2003.

* cited by examiner

VACUUM PUMPS AND METHODS OF MANUFACTURING THE SAME

CROSS REFERENCE TO RELATED APPLICATION

The present application claims priority to and the benefit of U.S. Provisional Application No. 62/426,833, filed on Nov. 28, 2016, and titled "Additive Manufacturing of Vacuum Pumps," the contents of which is incorporated herein by reference in its entirety.

FIELD

The present application relates to vacuum pumps and the fabrication of such pumps, and more particularly relates to the use of additive manufacturing to fabricate miniaturized diaphragm vacuum pumps.

BACKGROUND

A very exciting research thrust in microtechnology is the development of microelectromechanical systems (MEMS) that use a supply of gases at typically precise flow rates and pressure levels. These systems are sometimes referred to as miniaturized analytical instruments, and are used in a variety of fields, including but not limited to mass spectroscopy. Such systems often utilize vacuum pumps to operate them because the pump(s) can create and maintain vacuum at a given flow rate. Some such vacuum pumps include positive displacement pumps, which exploit gas compressibility to create and maintain vacuum. Such pumps use active and/or passive valves to compress pockets of gas at low pressure to higher, e.g., atmospheric, pressure using a variable volume, i.e., compression chamber. Positive displacement pumps are adequate for creating and supporting low vacuum (e.g., down to Torr level), and as roughing pump in combination with other kinds of pumps to reach lower pressure. A diaphragm pump is a kind of positive displacement pump in which changes in volume of the compression chamber are caused by the displacements of a flexible membrane.

As the desire for miniaturized diaphragm pumps, and miniaturized pumps more generally, has increased, efforts to manufacture such MEMS-style pumps have also increased. Many attempts to manufacture miniaturized diaphragm pumps have relied upon microfabrication as the primary process for manufacturing. While miniaturized pumps (diaphragm and otherwise) can be produced using microfabrication, this manufacturing technique results in a number of complications or otherwise undesirable results. For example, pumps formed by microfabrication often result in pumps having a ratio of dead volume to total pump volume that is significant (e.g., twenty percent or greater), which can lead to pressure drops in the pumps that negatively impact their performance (i.e., the vacuum generation capabilities of the pumps are limited). Pumps formed by microfabrication often have undesirable flow rates, which can be due to large hydraulic resistances of the hydraulic network, small compression chambers actuated at a slow pace, and/or significant valve leak rates. Still further, using microfabrication to build miniaturized diaphragm pumps can be expensive and time-consuming, which makes them incompatible with low-cost applications, such as prototyping, miniature roughing pump applications of all sorts including sampling pumps, metering pumps, packaging pumps, pick and place pumps, backing pumps for high vacuum pumps used on thin film deposition and etch equipment, analytical equipment, surface science equipment, and mass spectroscopy equipment.

To the extent other fabrication techniques besides microfabrication have been utilized for microfluidic devices, these techniques often only use a single material to create the device. This is even the case for devices that include monolithically integrated actuators, e.g., valves. The use of a single material for other printing techniques is likely because of the limitations in those fabrication techniques and the difficult nature of trying to utilize multiple materials when fabricating a small device.

Accordingly, there is a need for techniques for fabricating miniaturized pumps, such as miniaturized diaphragm pumps, that allow for low cost, rapid fabrication for the purposes of prototyping and/or more permanent fabrication, while also allowing for the fabrication of devices that include multiple materials. The techniques should result in pumps that provide good pressure values or vacuums and flow rates, while being leak-tight.

SUMMARY

The present disclosure provides for multi-material, additively manufactured, miniaturized diaphragm pumps. The pumps include a plurality of valves and a compression chamber that are made of one or more flexible materials, with the valves and compression chamber, among other components of the pumps, having different stiffnesses. The pumps provide for improved performance and longevity never before realized in an additively manufactured pump prior to the techniques presented herein.

In one exemplary embodiment, a diaphragm pump includes a compression chamber, a first valve, a second valve, and a diaphragm. The compression chamber is defined by a first surface, a second surface that is opposed to the first surface, and a conical outer wall that extends between the first and second surfaces. The conical outer wall has a bowed configuration in which the outer wall has a generally concave shape. The first valve is disposed more proximate to the first surface than the second surface of the compression chamber and is in fluid communication with the compression chamber and a first fluid port (which may or may not be part of the pump itself). The second valve is also disposed more proximate to the first surface than the second surface of the compression chamber, with the second valve being in fluid communication with the compression chamber and a second fluid port (which may or may not be part of the pump itself). The diaphragm is disposed more proximate to the second surface than the first surface of the compression chamber and is configured to receive a force from a piston to actuate the compression chamber. The first valve and the second valve can be configured such that one valve of the first and second valves is closed while the other valve is open to allow fluid to flow from the respective first or second fluid port and into the compression chamber by way of a vacuum force, and the other valve is closed while the one valve is open to allow fluid to flow from the compression chamber and into the respective first or second fluid port by way of an exhaust force.

In some embodiments, the pump can include the first fluid port and/or the second fluid port. In other embodiments, the first and/or second fluid port can be disposed in a plate or the like disposed adjacent to the pump. The pump can also include a piston that is configured to engage the diaphragm to actuate the compression chamber. In such embodiments, the pump can also include one or more actuators (e.g., pneumatic, electromagnetic) that are configured to selectively operate the piston the control the flow of fluid into and out of the compression chamber. Similarly, the pump can include one or more actuators (e.g., pneumatic, electromagnetic) that are configured to selectively operate the first and second valves to control fluid flow therethrough.

The conical outer wall can be configured such that it has a value of rho that is approximately in the range of about 0.5 to about 1.0. Alternatively, or additionally, a radius of curvature of the conical outer wall can be approximately in the range of about 50 microns to about 10 meters.

Each of the compression chamber, the first valve, the second valve, and the diaphragm can be formed by way of additive manufacturing techniques. Other components that can also be provided as part of the pump (e.g., fluid ports, piston, etc.) can also be formed by additive manufacturing techniques. The additive manufacturing techniques can include polyjet printing, fused filament fabrication printing, and stereolithography printing. The compression chamber, the first and second valves (the fluid ports, pistons, etc. if included), and the diaphragm can be formed by a plurality of materials deposited during formation by the additive manufacturing techniques, with some portion of at least one of the compression chamber, the first and second valves (the fluid ports, pistons, etc. if included), and the diaphragm having some make-up of materials that is different than some other portion of at least one of the compression chamber, the first and second valves (the fluid ports, pistons, etc. if included), and the diaphragm.

Each of the compression chamber, the first and second valves, and the diaphragm can include a flexible photo-definable polymer. The same can be true for first and second fluid ports, pistons, and other components of the pump. The flexible photo-definable polymer can include one or more TangoBlack® materials (e.g., TangoBlack Plus®). Other materials that can be used include a flexible fused filament fabricated polymer, such as Ninjaflex, Cheetah, Armadillo, and Nylon. Still further, other materials that can be used include one or more photo-definable polymers, such as fsl3d, Formlabs' flexible resin, and Spot-A Materials' flexible resin.

In some embodiments, the diaphragm pump can include a piston block and a valve block. The piston block can include the compression chamber and a first portion of each of the first and second valves, and the valve block can include a second portion of the first and second valves. The piston block can also include the piston, and the valve block can also include the first and second fluid ports, or portions thereof, when provided as part of the pump. Each of the piston block and the valve block can be monolithically formed and can be coupled together by way of a vacuum-tight seal.

A flow rate of the pump can be greater than about 4.0 standard cubic centimeters per minute. A pressure ratio of the pump can be greater than approximately 4.75. A base pressure can be less than about 160 Torr. The compression chamber can include a stroke approximately in the range of about 0.15 millimeters to about 8 millimeters. A dead volume of the compression chamber can be approximately five percent or less. A total pumping volume of the compression chamber can be approximately in the range of about 0.1 $cm^3$ to about 3.0 $cm^3$. A thickness of the diaphragm can be approximately in the range of about 0.05 millimeters to about 5.0 millimeters.

A multi-stage diaphragm pump system can also be provided. In some embodiments, the system can include a first diaphragm pump in accordance with those described above coupled in series to at least one additional diaphragm pump in accordance with those described above (or other diaphragm pumps for that matter). In some embodiments, the system can include a first diaphragm pump in accordance with those described above coupled in parallel to at least one additional diaphragm pump in accordance with those described above (or other diaphragm pumps for that matter). Some systems can include pumps coupled in both series and parallel.

In one exemplary method of manufacturing a vacuum pump, the method includes depositing at least one material onto a surface to form a first layer of a miniaturized diaphragm pump, depositing the at least one material onto the first layer of the miniaturized diaphragm pump to form a second layer of the miniaturized diaphragm pump, and continuing to deposit the at least one material onto subsequent layers of the miniaturized diaphragm pump to form the complete miniaturized diaphragm pump by way of additive manufacturing. The complete miniaturized diaphragm pump includes a compression chamber and at least one valve to control fluid flow between the compression chamber and at least one fluid port (which can be, but is not necessarily part of, the pump), with each of the compression chamber and the at least one valve being formed by the deposited at least one material.

The at least one material can include at least two materials, with the at least two materials having different flexibility properties than each other. In some such embodiments, the compression chamber and the at least one valve can be formed by the at least two materials with at least one of the compression chamber and the at least one valve having some make-up of materials that is different than another of the compression chamber and the at least one valve.

The at least one material can include a flexible photo-definable polymer. The flexible photo-definable polymer can include one or more TangoBlack® materials (e.g., TangoBlack Plus®). Other materials that can be used include a flexible fused filament fabricated polymer, such as Ninjaflex, Cheetah, Armadillo, and Nylon. Still further, other materials that can be used include one or more photo-definable polymers, such as fsl3d, Formlabs' flexible resin, and Spot-A Materials' flexible resin.

The at least one material can include a plurality of materials, with a first material of the plurality of materials being a sacrificial material. In such embodiments, the method can include removing the sacrificial material from the complete miniaturized diaphragm pump such that at least one void disposed within the complete miniaturized diaphragm pump results from removal of the sacrificial material.

The first layer and the second layer of the miniaturized diaphragm pump can form a first portion of the complete miniaturized diaphragm pump. In such embodiments, continuing to deposit the at least one material onto subsequent layers of the miniaturized diaphragm pump can include continuing to deposit the at least one material onto subsequent layers of the miniaturized diaphragm pump to form the first portion of the complete miniaturized diaphragm pump, depositing the at least one material onto a surface to form a first layer of a second portion of the complete miniaturized diaphragm pump, depositing the at least one material onto the first layer of the second portion to form a second layer of the second portion of the complete miniaturized diaphragm pump, and continuing to deposit the at least one material onto subsequent layers of the second portion of the complete miniaturized diaphragm pump. Still further, the method can then include coupling the first portion of the complete miniaturized diaphragm pump to the second portion of the complete miniaturized diaphragm pump to form a vacuum-tight seal therebetween such that the complete miniaturized diaphragm pump includes the first portion and the second portion. In some such embodiments, the at least one material can include a plurality of materials, with a first material of the plurality of materials including a sacrificial material. In such embodiments, the method can include removing the sacrificial material from at least one of the first portion and the second portion prior to coupling the first portion to the second portion such that removal of the sacrificial material provides at least one void disposed within the complete miniaturized diaphragm pump.

The complete miniaturized diaphragm pump can include at least one fluid port, with the at least one fluid port being formed by the deposited at least one material. Alternatively, or additionally, the complete miniaturized pump can include a diaphragm and a piston being formed by the deposited at least one material. Still further, alternatively, or additionally, the complete miniaturized pump can include at least one actuator configured to selectively operate the at least one valve, the at least one actuator being formed by the deposited at least one material.

In some embodiments, the method can include tuning the complete miniaturized diaphragm pump. In some such embodiments, the at least one valve can include a vacuum valve and an exhaust valve, with the vacuum valve being configured to control a flow of fluid from a vacuum port and to the compression chamber and the exhaust valve being configured to control a flow of fluid from the compression chamber to an exhaust port. Tuning can then include closing the vacuum valve and opening the exhaust valve, actuating the compression chamber to advance fluid from the compression chamber and into the exhaust port, closing the exhaust valve and opening the vacuum valve, actuating the compression chamber to advance fluid from the vacuum port and into the compression chamber, and adjusting at least one of a time it takes for the vacuum valve to open, a time it takes for the exhaust valve to open, a time it takes for the vacuum valve to close, a time it takes for the exhaust valve to close, a pressure at which fluid flows through the vacuum valve, and a pressure at which fluid flows through the exhaust valve.

In some embodiments, depositing at least one material onto a surface, depositing the at least one material onto the first layer, and continuing to deposit the at least one material onto subsequent layers can include operating a polyjet printer to deposit the at least one material. Alternatively, or additionally, other additive manufacturing techniques that can be used include fused filament fabrication printing and stereolithography printing.

The compression chamber and the at least one valve can be formed by a plurality of materials deposited during formation by the additive manufacturing techniques. The method of manufacturing can be performed without having to change a physical state of the at least one material after it has been deposited.

The at least one valve can be an active valve(s) and/or a passive valve(s). In some embodiments, the method can further include depositing at least one film on an outermost surface of at least one of the compression chamber and the at least one valve to increase chemical resiliency of the complete miniaturized diaphragm pump.

The compression chamber of the complete miniaturized pump can have a dead volume that is approximately five percent or less. The compression chamber of the complete miniaturized pump can have a total pumping volume that is approximately in the range of about 0.1 $cm^3$ to about 3.0 $cm^3$.

BRIEF DESCRIPTION OF DRAWINGS

This disclosure will be more fully understood from the following detailed description taken in conjunction with the accompanying drawings, in which.

DETAILED DESCRIPTION

Figure 1:
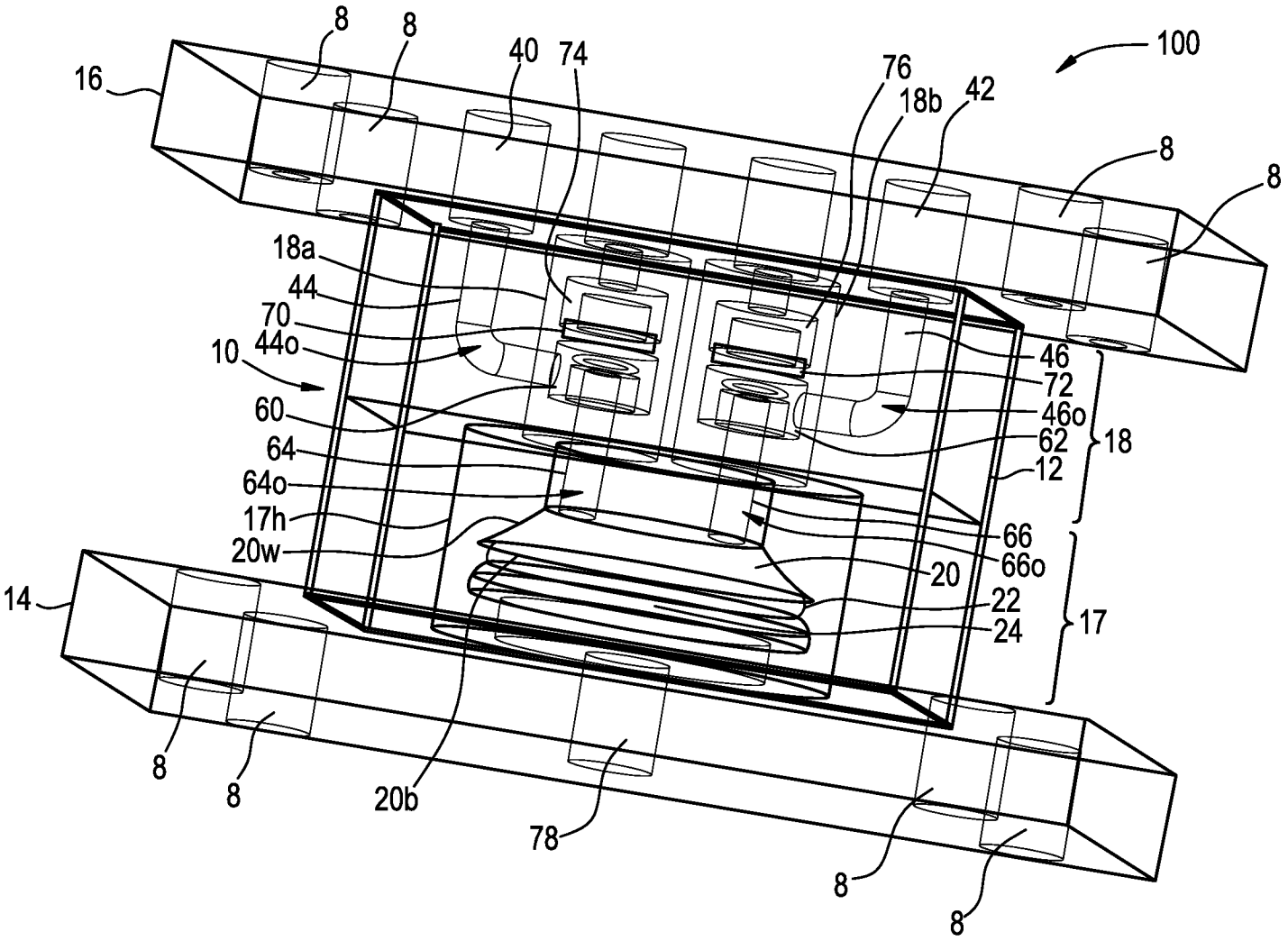
FIG. 1 is a perspective view of one exemplary embodiment of a miniaturized vacuum pump.
Figure 2:
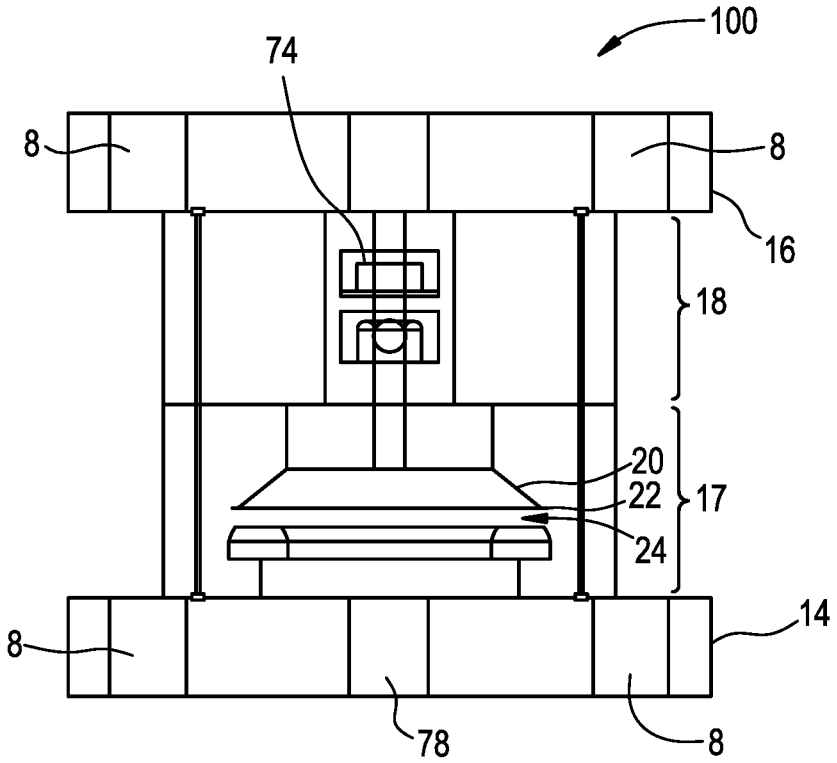
FIG. 2 is a side view of the miniaturized vacuum pump of FIG. 1.
Figure 3:
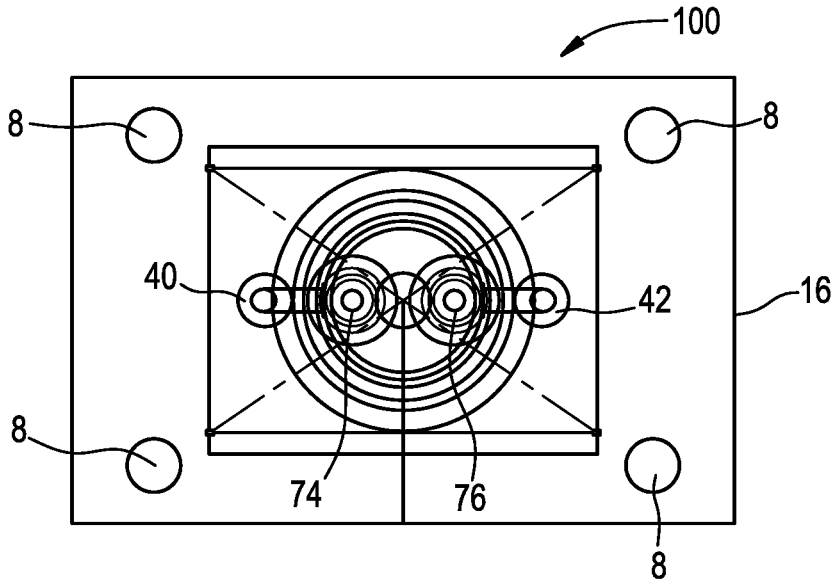
FIG. 3 is a top view of the miniaturized vacuum pump of FIG. 1.
Figure 4:
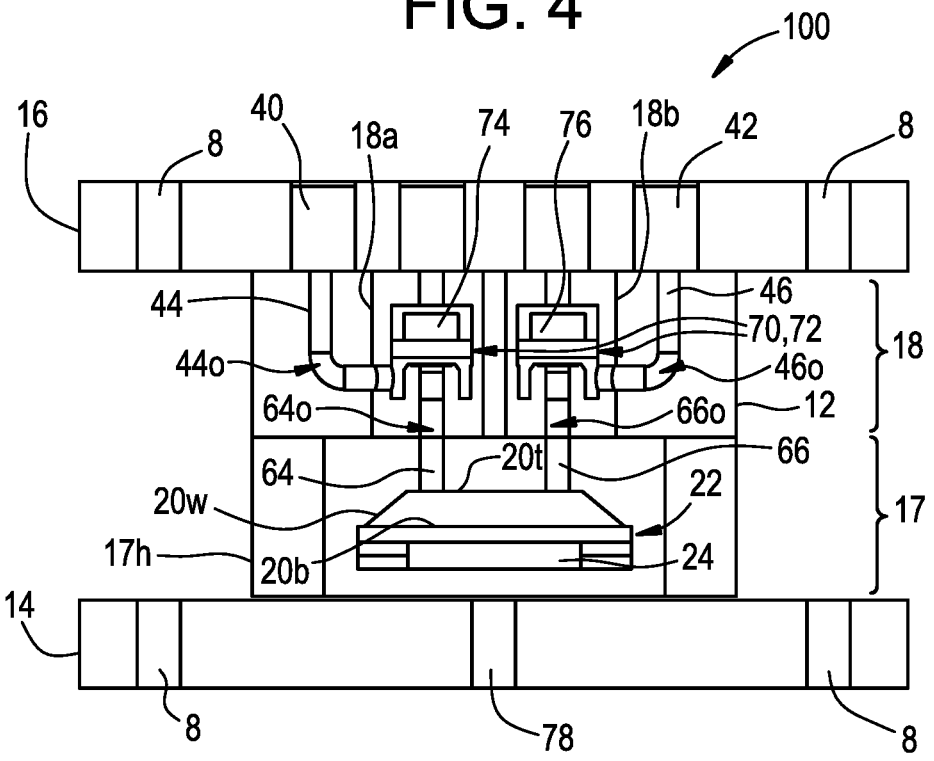
FIG. 4 is a cross-sectional view of the miniaturized vacuum pump of FIG. 1 taken along line A-A.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

To the extent that linear or circular dimensions are used in the description of the discloses devices, systems, and methods, such dimensions are not intended to limit the types of shapes that can be used in conjunction with such devices, systems, and methods. A person skilled in the art will recognize that an equivalent to such linear and circular dimensions can easily be determined for any geometric shape. Sizes and shapes of the devices and systems, and the components thereof, can depend, at least in part, on the intended use of the devices and systems, and the sizes and shapes of other devices, systems, and the like with which the disclosed devices and systems are used. Thus, while the present disclosure generally describes and/or illustrates disclosed embodiments as being "miniaturized," a person skilled in the art will recognize disclosures of the present application can be adapted for larger and smaller versions of pumps and other instruments without departing from the spirit of the present disclosure. Likewise, while the present disclosure generally provides for diaphragm pumps, a person skilled in the art will recognize other types of pumps and other devices to which the printing methods disclosed can be adapted for use in producing such pumps and other devices.

To the extent the term "fluid" is used, a person skilled in the art will understand the term encompasses both liquids and gases, unless otherwise explicitly stated. Further, the present disclosure includes some illustrations and descriptions that include prototypes or bench models. A person skilled in the art will recognize how to rely upon the present disclosure to integrate the techniques, systems, devices, and methods provided for into a product, such as a consumer-ready, factory-ready, or lab-ready three-dimensional printer.

The present disclosure generally provides for techniques for fabricating a pump (e.g., a miniaturized vacuum pump) using additive manufacturing. Prior to the present disclosure, pumps like miniaturized vacuum pumps were produced using techniques that did not involve additive manufacturing, such as microfabrication. The resultant pumps were limited by many of the factors discussed above in the Background. Pumps, and their associated systems, provided for in the present disclosure overcome many of the limitations of previous pumps because they allow for the creation of pumps that have equal or superior performance to known pumps while offering benefits including but not limited to rapid prototyping, device customization, definition of free-form geometries, the selection of broader materials by allowing for printing with multiple materials in a quick and efficient manner, and attaining minimum feature sizes on par with microfluidic systems (e.g., layer height approximately in the range of about 5 μm to about 300 μm and XY voxel size approximately in the range of about 5 μm to about 500 μm). Performance is on-par or superior to existing pumps at least because the present techniques allow for leak-tight, closed channels or cavities of the pump, thus allowing for large compression chamber displacements than what is achievable with standard microfabrication, which in turn provides for better vacuum generation and larger flow rates.

More particularly, the present disclosure provides for additive manufacturing techniques such as polyjet printing for fabricating pumps and their related systems. The pumps can include a compression chamber, at least one fluid port (often two fluid ports, identified herein sometimes as a vacuum port and an exhaust port, and sometimes more generally referred to as ports), at least one valve (often two valves, identified herein sometimes as a vacuum valve and an exhaust valve), and a diaphragm. The pump may also include a piston and one or more actuators to control the valve(s) in regulating the flow of fluid between the fluid port(s) and the compression chamber. A plurality of pumps can be linked together in series to form multi-stage pump system. Additional details about the techniques for manufacturing pumps, about the pumps themselves, and systems that can be formed, tested, etc. in view of the provided for techniques and pumps are provided below. The disclosures provided for allow for effective and efficient pumps to be provided by additive manufacturing for use in prototyping, miniature roughing pump applications of all sorts including sampling pumps, metering pumps, packaging pumps, pick and place pumps, backing pumps for high vacuum pumps used on thin film deposition and etch equipment, analytical equipment, surface science equipment, and mass spectroscopy equipment, among other uses a person skilled in the art will appreciate in view of the present teachings.

Single-Stage Miniaturized Diaphragm Pumps

FIGS. 1-4 provide for one exemplary embodiment of a miniaturized, single-stage diaphragm pump 10. The pump 10 is a three dimensional object having a housing 12 with a generally rectangular prism shape, although a person skilled in the art will recognize the pump can be fabricated into other shapes as well without departing from the spirit of the present disclosure. The pump 10 can be a standalone pump or, as shown, it can include base plates 14, 16 disposed on opposed top and bottom surfaces of the pump, identified as a pump 100. To the extent the pump 10 and the pump 100 are used herein, they are generally used interchangeably. Further, as provided for herein, the pump 10 is fabricated separate from the plates 14, 16, although in other embodiments they can be fabricated simultaneously and/or the design can be such that the plates and related components can be included as part of the pump itself.

As shown, the pump 10 can include a compression chamber 20, one or more fluid ports 40, 42 (which are provided for in the plate 16, which may or may not being considered as part of the pump itself), and one or more valves 60, 62, among other features. The compression chamber 20 is generally in fluid communication with the one or more valves 60, 62 and the one or more fluid ports 40, 42, with the one or more valves 60, 62 being operable to control the flow of fluid between the fluid port(s) 40, 42 and chamber 20. In the illustrated embodiment, there are two fluid ports 40, 42 and two valves 60, 62, although there can be fewer or more fluid ports and valves depending, at least in part, on the desired use of the pump, the other components or devices with which the pump is being used, and the preferences of the user.

As described herein, the pump itself can be manufactured monolithically in one part, or portions of the pump can be printed monolithically and then combined together to form the pump. In the present disclosure, the pump 10 is divided into two portions or sections 17 and 18, with a first section 17 being described as the piston block and a second section 18 being described as the valve block. Any number of sections can be used, and the names of the sections do not have any practical significance, although generally the name of the block identifies one or more components associated with the block. Alternatively, the piston and valve blocks 17, 18 can be described as first and second blocks, sections, portions, etc., respectively, among other possible naming conventions, without departing from the spirit of the present disclosure. Further, the illustrated embodiment includes first and second plates 14, 16, with the first plate 14 being adjacent to the first block 17 and the second plate 16 being adjacent to the second block 18. In some instances, the first plate 14 can be considered to be part of the first block 17, and the second plate 16 can be considered to be part of the second block 18.

As shown, the first block 17, or piston block, is provided as a bottom portion of the pump 10. The piston block includes a first housing **17*h* in which each of the compression chamber 20, a diaphragm 22, a piston 24, a portion of the valves 60, 62 (as shown, tubes or pipes 64, 66, as described in greater detail below), and a piston actuation port 78 are disposed. The first housing 17*h* has a generally cylindrical shape with an outer wall that defines a volume within which the aforementioned components of the first block 17** are disposed.

The compression chamber 20 is a three-dimensional chamber that is defined by a first top surface **20*t*, a second bottom surface 20*b* that is opposed to the top surface 20*t*, and a conical outer wall 20*w* that extends between the first and second surfaces 20*t*, 20*b*. The chamber 20 can be described as a cone with a truncated tip, although many other shapes are possible without departing from the spirit of the present disclosure. The design of the compression chamber 20 can be such that it minimizes an amount of dead volume associated therewith, i.e., the amount of volume of the chamber 20 that is not utilized effectively during operation. In the presently illustrated compression chamber 20, this is achieved by a bowed configuration of the conical outer wall 20***w* such that the conical outer wall 20*w* has a generally concave shape. For example, the rho value of the conical outer wall 20*w* can be approximately in the range of about 0.5 to about 1.0, and in some embodiments it can be about 0.75. Alternatively, or additionally, a radius of curvature of the conical outer wall 20*w* can be approximately in the range of about 50 microns to about 10 meters, or more particularly approximately in the range of about 50 microns to about 1 meter, and in some embodiments it can be about 0.1 meters. The dead volume of the illustrated compression chamber 20 is about five percent or less. The teachings of the present disclosure generally allow for dead volume values that are about twenty percent or less, about ten percent or less, and about five percent or less. Further, the teachings of the present disclosure generally result in a total pumping volume of the compression chamber 20 that is approximately in the range of about 0.1 $cm^3$ to about 3.0 $cm^3$.

Figure 5:
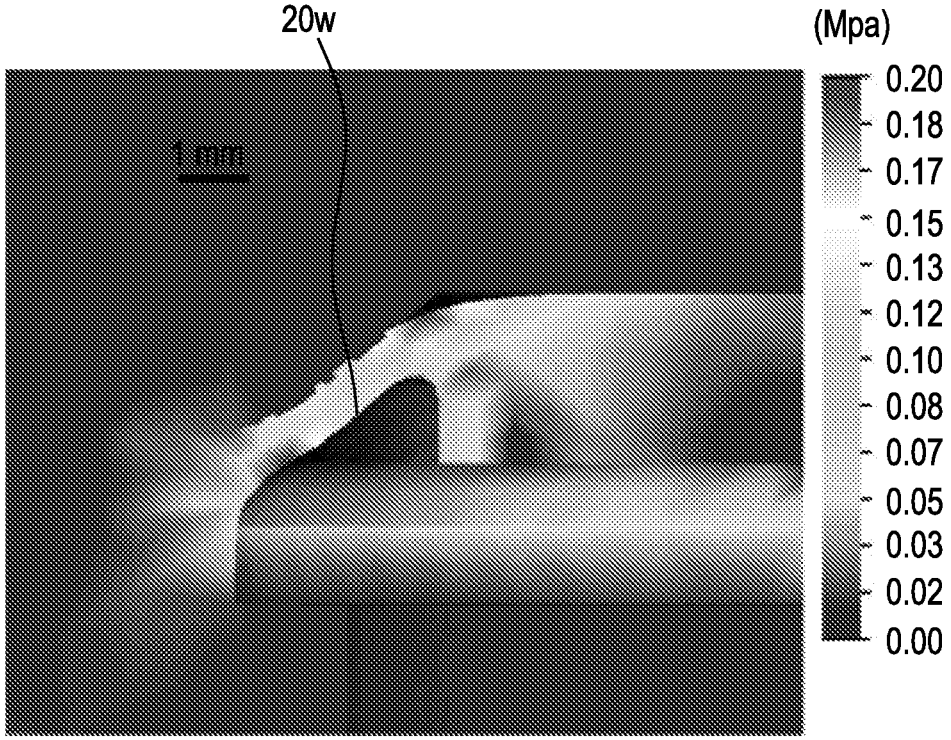
FIG. 5 is a cross-sectional view of a compression chamber of the pump of FIG. 1 that provides for a finite element stress analysis thereof when a piston of the pump is in full actuation.

The bowed configuration of the conical outer wall 20*w* is more clearly illustrated in FIG. 5. FIG. 5 is a finite element stress analysis of the compression chamber 20 of the pump 10 when the piston 22 (described in further detail) is in full actuation. In simulations performed using the presently illustrated pump, the displacement was set to a full stroke value of 2.4 mm. This is equivalent to a pressure of about 27.4 kPA applied to the compression chamber piston and the 3.6 mm radial diaphragm area. The maximum stress is estimated at about 0.20 MPa, which is well below a 1.9 MPa lower bound of tensile strength of material that was used in conjunction with the simulation (the material being TangoBlack Plus® polymer, as described further below). In the simulation, the compression chamber 20 was designed to allow for a maximum diaphragm elongation of about 20%, which corresponds to the suggested maximum elongation to avoid failure by fatigue of the TangoBlack Plus® polymer. As shown in FIG. 5, fillets at the edges of the conical outer wall 20*w* generally have the highest stresses. The present disclosure allows for a maximum stress that is estimated to be about 200 kPA, which is well below the 1900 kPA lower bound of the tensile strength of the material.

The compression chamber 20 can be in fluid communication with the first valve 60 and the second valve 62. A portion of the valves 60, 62, as shown respective first and second chamber tubes 64, 66 that define first and second tubular chamber openings 64*o*, 66*o* extending between the valves 60, 62 and the compression chamber 20, can be included as part of the first block 17. In other configuration, the piston block 17 can terminate at the first surface 20*t* of the compression chamber 20 such that such first and second chamber tubes 64, 66 extending between the compression chamber 20 and the valves 60, 62 to allow for fluid communication are disposed in another portion or block of the pump 10 (e.g., the second or valve block 18). Additional details about the first and second chamber tubes 64, 66 and first and second valves 60, 62 are provided further below.

Parameters of the compression chamber 20 that can be modified to attain longer lifetimes include a hardness of the printable material, a height of the printed slices or layers, a diaphragm thickness, and a compression chamber lateral wall thickness (i.e., width of the pump body). The following table demonstrates the impact of adjusting these parameters in various testing, with the lifetime column representing the largest number of actuation cycles measured before diaphragm failure for a given combination of parameters:

| PART | Slice Height (μm) | Pump Width (mm) | Diaphragm Thickness (mm) | Lifetime (Kilocycles) |
|---|---|---|---|---|
| Valve 1 | 25 | 24 | 1 | >1000 |
| Valve 2 | 25 | 28 | 1 | >2300 |
| Piston 1 | 25 | 24 | 1 | 20 |
| Piston 2 | 25 | 24 | 1 | 108 |
| Piston 3 | 25 | 28 | 0.9 | 75 |
| Piston 4 | 16 | 28 | 0.9 | >850 |

With the improvements made to the design, compression chamber diaphragms (described in greater detail below) exhibited lifetimes approaching one million cycles, while the valves membranes did not leak after more than two million cycles. Changing the hardness of the compression chamber assembly from Shore 27A to Shore 50A increased by five-fold the lifetime of the hardware; however, increase the hardness to 70A (not shown) resulted in a diaphragm being too stiff for full actuation, and a significant reduction in lifetime. Accordingly, an optimal hardness appears to be approximately 50A and variation of other aspects of the pump being priorities.

The thickness of the lateral material surrounding the compression chamber 20 was not equal on all sides in the about 24 mm wide design (the lateral material was about 2 mm thick on two opposite sides and about 7.5 mm thick on the other two); during actuation it was noticed that the thinner 2 mm thick walls deformed. Increasing the width of the pump from about 24 mm to about 28 mm provided wall thicknesses of about 4 mm and about 7.5 mm, resulting in less deformation during actuation. During this iteration, the diaphragm thickness was also decreased from about 1 mm to about 0.9 mm to improve flexibility without causing leaks through the membrane. Printed in 25 μm thick layers, the design yielded shorter cycle lifetimes than the previous hardware iteration, but printed with 16 μm layers results in an order of magnitude increase in the lifetime, i.e., >850 k cycles actuation prior to leakage. A person skilled in the art, in view of the present disclosures, will understand how to further optimize the compression chamber, as well as other components of the pump.

A diaphragm or membrane 22 is provided adjacent to the second surface 20*b* of the compression chamber 20. As shown, the diaphragm 22 is disposed more proximate to the second surface 20*b* than the first surface 20*t* of the compression chamber 20, although in some embodiments the diaphragm 22 can be disposed around more portions of the outer surface than just the second surface 20*b*, including the entire surface. The diaphragm 22 is generally cylindrical in nature with a cross-section that can be described as elliptical. As shown, a length of the diaphragm 22 can be approximately a length of the chamber 20, although in other embodiments a length of the diaphragm 22 can be different than the length of the chamber 20. A thickness of the diaphragm 22 can vary, depending on the size of the other components and the desired use, among other factors, although often it is generally considered to be thin when compared, for example, to a thickness of the compression chamber 20. By way of non-limiting examples, a thickness of the diaphragm 22 can be approximately in the range of about 0.05 millimeters to about 5.0 millimeters, and in some embodiments it can be about 1.0 millimeter. The diaphragm 22 assists in receiving actuation from the piston 24 to cause fluid to be drawn into or out of the compression chamber 20. In other words, the diaphragm 22 receives a force from the piston 24 to actuate the compression chamber 20. It also can provide a fluid-tight seal between the piston 24 and the compression chamber 20. In particular, because of the use of additive manufacturing as provided for herein, the diaphragm 22 can be flexible, thin, and leak-tight, which can be significant in implementing a positive displacement diaphragm vacuum pump.

The deflection of the diaphragm 22 can be modeled using linear deformation theory if the deflection of the diaphragm is less than about half its thickness. However, when the deformation of the diaphragm 22 is larger, the in-plane tensile stress is comparable (or larger) than the bending stresses, thereby increasing the plate stiffness. In such case, the non-linear differential equation that describes the displacement w of a circular, uniform diaphragm made of an isotropic, elastic, and linear material, with loads perpendicular to the surface of the diaphragm, constrained at is outer radius r=a, and attached to a central stiff piston of radius r=b can be modeled as:

$$\frac{d^3w}{dr^3} + \frac{1}{r}\frac{d^2w}{dr^2} - \frac{1}{r^2}\frac{dw}{dr} - \frac{N_r}{D}\frac{dw}{dr} = \frac{Q}{D} \tag{1}$$

with boundary conditions:

$$w(r=a)=0,\ \frac{dw}{dr}(r=a)=0,\ \frac{dw}{dr}(r=b)=0 \tag{2}$$

where $N_r$ is the in-plane tension load per unit of circumference, D is the flexural rigidity of the diaphragm, i.e., $$D = \frac{Et_d^3}{12(1-v^2)} \tag{3}$$

where E and v are the Young's modulus and Poisson ratio of the material, $t_d$ is the thickness of the diaphragm, and Q is the shear force per unit length, given by $$Q = \frac{F_{piston}}{2\pi \cdot r} - \frac{\Delta P(r^2-b^2)}{2r} \tag{4}$$

where ΔP is the pressure difference across the diaphragm and $F_{piston}$ is the force acting on the piston, i.e., $\pi \times \Delta P \times b^2$ if pneumatically actuate. There is no closed form solution of equation (1).

Four physical properties are required to model the pump 10: the Young's modulus, the Poisson ratio, the tensile strength $\sigma_y$, and the density of the material, ρ. The Young's modulus and Poisson's ratio used in simulations performed in conjunction with the present disclosures were set at 0.76 MPa and 0.3, respectively. The tensile strength values measured by previous disclosures are within the range of typical tensile strength for the TangoBlack® family of polymers provided by the vendor (Stratasys, Eden Prairie, Minn.); the ensile strength used in the studies performed in conjunction with the present disclosure was set at 1.9 MPa, which is the lower bound of the range provided by the vendor for the TangoBlack® blend with 50A Shore hardness. For the density of the material, the middle of the range provided by the vendor was adopted, i.e., 1.125 gr/cm$^3$.

The fundamental resonance frequency $f_r$ of a diaphragm with $D_d$ diameter and $t_d$ thickness is:

$$f_r = 2\pi\left(\frac{1.015}{D_d}\right)^2\sqrt{\frac{E \cdot t_d^2}{12\rho(1-v^2)}} \tag{5}$$

using $D_d$=20 mm, $t_d$=0.9 mm, and the values of the Young's modulus and Poisson values previously quoted, results in a natural frequency of the compression chamber equal to about 114.6 Hz. Finite element simulations of the pump 10 (e.g., as shown in FIG. 5) using the physical values quoted estimate at 106 Hz the natural frequency of the compression chamber 20, which is slightly faster than the actuation time of the actuators 340, 342, 344 (e.g., solenoid valves) of the system 300 described below with respect to FIG. 6.

The piston 24 is disposed below the diaphragm 22 and is configured to provide an actuation force to the diaphragm 22, and in turn to the compression chamber 20. Like the other components of the pump 10, the piston 24 can be configured to have many different sizes, shapes, and configurations, and in the illustrated embodiment the piston 24 is generally cylindrical and has a length that is less than the length of the diaphragm 22. The piston 24 can be actuated using many different mechanisms, but as shown a port 78 is disposed below the piston 24 and configured to actuate the piston 24. As the piston 24 is actuated towards the diaphragm 22, towards a full actuation position, it supplies a force to the compression chamber 20 to drive fluid out of the compression chamber 20 and into at least one of the fluid ports 40, 42, via at least one of the valves 60, 62. Likewise, as the piston 24 is actuated away from the diaphragm 22, towards a resting position, it supplies a force to the compression chamber 20 to draw fluid into the compression chamber 20 from at least one of the fluid ports 40, 42, via at least one of the valves 60, 662. In some embodiments, the piston 24 has a natural frequency during operation. By way of non-limiting example, a natural frequency of the piston 24 can be approximately in the range of about 0.1 Hz to about 1000 Hz, and in some embodiments the natural frequency can be about 4 Hz. The frequency of the piston 24 can subsequently be translated to the diaphragm 22 and the compression chamber 20, although there may be some loss of frequency between the components. In some instances, a stroke of the compression chamber 20 can be characterized as being approximately in the range of about 0.15 millimeters to about 8 millimeters.

In the illustrated embodiment, the second block 18, or valve block, is provided as a top portion of the pump 10. The valve block 18 includes a first valve housing 18*a* in which the first valve 60, at least a portion of the first chamber tube 66, a first valve membrane 70, and at least a portion of a first actuator port 74 is disposed, and a second valve housing 18*b* in which the second valve 62, at least a portion of the second chamber tube 68, a second valve membrane 72, and at least a portion of a second actuator port 76 is disposed. As shown, a first fluid port tube 44 extends from the first valve housing 18*a* and towards the first fluid port 40 disposed in the second, top plate 16, and a second fluid port tube 46 extends from the second valve housing 18*b* and towards the second fluid port 42 disposed in the top plate 16. In some embodiments, any of the fluid ports 40, 42 can be provided in the valve block 18. Likewise, portions of the first and second actuator ports 74, 76 can be disposed fully in the valve block 18, fully in the top plate 16, or in both the valve block 18 and the top plate 16 as shown.

The first and second valves 60, 62 can be any type of valve configured to control a flow of fluid. In the illustrated embodiment, first and second valves 60, 62 are active valves that can be selectively opened and closed by way of actuators disposed in or otherwise associated with the first and second actuator ports 74, 76. The use of active valves can allow for optimized pump performance by being able to time the actuation of the opening and closing of the valves. Alternatively, passive valves (e.g., passive check valves) can be used in lieu of active valves. The use of passive valves can help limit the amount of energy being used by the pump since they do not typically require additional energy and signals for actuation, and typically can be optimized to yield less dead volume than active valve pumps. The first and second valves 60, 62 can be operable by the same principles, but they do not have to necessarily do so (e.g., one can be passive and one can be active or both can be active, but operated by different means). In the illustrated embodiment, the first and second valves 60, 62 are disposed above the compression chamber 20 such that they are more proximate to the first surface 20*t* than the second surface 20*b*, with the chamber tubes 64, 66 (which can be considered to be part of the compression chamber 20, part of the valve 60, 62, and/or their own standalone structures) being disposed between the valves 60, 62 and compression chamber 20 to facilitate fluid communication therebetween (via the openings 64*o*, 660).

A gap between valve seats of the valves 60, 62 and the valve membranes 70, 72 may vary, and in some embodiments the gap can be approximately in the range of about 0.1 millimeters to about 10 millimeters, including, for example, a gap that is approximately 1 millimeter. The gap is generally large enough to accommodate flow through the pump 10 and small enough to allow for rapid actuation and extended valve membrane 70, 72 lifetimes. A person skilled in the art, in view of the present disclosures, will understand how to manage the gaps and provided the desired effect.

The first and second valve membranes 70, 72 are disposed above at least portions of the first and second valves 60, 62 as shown. Similar to the diaphragm 22, a length of the first and second membranes 70, 72 can be approximately a length of the respective first and second valves 60, 62, although in other embodiments a length of the first and second membranes 70, 72 can be different than the length of their respective valves 60, 62. A thickness of the membranes 70, 72 can vary, depending on the size of the other components and the desired use, among other factors, although often it is generally considered to be thin when compared, for example, to a thickness of the compression chamber 20. By way of non-limiting examples, a thickness of the first and second membranes 70, 72 can be approximately in the range of about 0.1 millimeters to about 2.0 millimeters, and in some embodiments it can be about 1.0 millimeter. The thickness of the first and second membranes 70, 72 can be, but do not have to be, substantially equal. The first and second membranes 70, 72 assist in receiving actuation from the first and second valve actuators disposed in the valve actuator ports 74, 76 to cause the valves 60, 62 to selectively open and close. They also can provide a fluid-tight seal between the valve actuator ports 74, 76 and the valves 60, 62. In particular, because of the use of additive manufacturing as provided for herein, the valve membranes 70, 72 can be flexible, thin, and leak-tight, which can be significant in implementing a positive displacement diaphragm vacuum pump.

The first and second chamber tubes or pipes 64, 66 can provide fluid communication between the first and second valves 60, 62 and the compression chamber 20. Likewise, the first and second fluid port tubes or pipes 44, 46 can provide fluid communication between the first and second valves 60, 62 and the first and second fluid ports 40, 42. Thus, in combination, fluid communication can be provided between the first and second fluid ports 40, 42 and the compression chamber 20. As shown, the first and second chamber tubes 64, 66 and first and second fluid port tubes 44, 46 can be cylindrical or tubular in nature. The chamber tubes 64, 66 and fluid port tubes 44, 46, along with the components associated therewith (e.g., fluid ports 40, 42, valves 60, 62, compression chamber 20) can form a pipe network, including an inlet pipe network that flows towards the compression chamber 20 and an outlet pipe network that flows away from the compression chamber 20.

In the illustrated embodiment, first and second fluid ports 40, 42 are provided as part of the second, top plate 16. The fluid ports 40, 42 as shown can be considered to have volumes associated therewith in which fluid can be disposed and/or received. The first and second fluid ports 40, 42 in the illustrated embodiment are cylindrical openings formed in the plate 16 and configured to be in fluid communication with the respective first and second fluid port tubes 44, 46. The first and second actuator ports 74, 76 can be similarly shaped, and can be configured to receive various actuators for actuating the valves. A similar, third actuator port 78 can be provided as part of the first, bottom plate 14 to drive or otherwise operate the piston 24. A person skilled in the art will recognize any number of actuators that can be provided in any of the first, second, and third actuator ports 74, 76, and 78, including but not limited to pneumatic, mechanical, electro-mechanical, electromagnetic, piezo-electric, thermal (bimetallic), electrostatic, and fluid actuators. Further, in the illustrated embodiment, the first and second fluid ports 40, 42 and the first and second actuator ports 74, 76 are formed in a linear array with sufficient spacing to allow for use of miniature brass pipe fittings barbed or otherwise threaded for ⅛ inch tubing to be associated therewith, including with an o-ring. Likewise, the third actuator port 78 can be configured to receive other components. For example, the port 78 can be barbed or otherwise threaded to accommodate a miniature brass fitting with an o-ring for actuation of the piston 24.

The top and/or bottom plates 16, 14 can be considered to be part of the pump 10 such that the pump 10 includes any number of the respective ports of the plates. Alternatively, either or both of the plates 16, 14 can be considered a separate component(s) such that the pump 10 does not include the port(s) associated with the plate(s). As shown, the top and bottom plates 16, 14 can be rectangular prisms, although other shapes and configurations are possible. In the illustrated embodiment, each plate 16, 14 includes four through-holes 8—one proximate to each corner of the respective plates 16, 14. The through-holes 8 can be used to couple to the pump 10 to another object, for instance by using bolts and nuts to attach the pump to another fixture (see, e.g., FIG. 6).

Notably, just because a component of the pump 10, or a portion thereof, is illustrated as being part of one block 17, 18, it does not mean that component, or portion thereof, must necessarily be part of that block. A person skilled in the art will recognize that such components, or portions thereof, can be provided for as part of any portion of the pump 10 without departing from the spirit of the present disclosure.

The present disclosure allows the various components of the pump 10 to be printed from different materials and combinations thereof. Thus, components that are desired to be more flexible can be printed using different materials that components that are desired to be more rigid. A person skilled in the art will recognize various components, including portions thereof, that are preferably more flexible and/or preferably more rigid. The materials per component can be a single material or a combination of materials, as a person skilled in the art will recognize is possible in view of the additive manufacturing capabilities provided for herein. As described below, in some instances one or more sacrificial materials can be included as part of the printing process, for instance to fill voids, openings, chambers, etc. and thus provide stability during printing, with such sacrificial material(s) being configured to be removed before use of the pump.

Because of the additive manufacturing techniques disclosed herein, components such as the compression chamber 20, the first fluid port 40, the second fluid port 42, the first valve 60, the second valve 62, and the diaphragm 22, among other components of the pump 10 (e.g., the valve membranes 70, 72) can be formed by a single material or multiple materials that are deposited during formation, and some portion of any one or more of these components can have some make-up of material(s) that is different than some other portion of the same component or one or more of the other components. That is, each component of the pump 10 is capable of being fabricated to have any material configuration, regardless of the material configuration of the other components of the same pump.

While many different materials can be used to print the structures of the pump 10 and related components, in some embodiments a flexible photo-definable polymer can be used. A particularly useful flexible photo-definable polymer uses a TangoBlack® polymer, such as TangoBlack Plus®. TangoBlack Plus® has a Young's modulus equal to about 0.3 MPA and a tensile strength equal to about 0.8 MPa. In view of the additive manufacturing techniques provided for herein, a maximum elongation of the TangoBlack Plus® material can be achieved of up to 220% with a Shore hardness of 27A. In some instances, the TangoBlack Plus® material can be mixed with different ratios of base materials, such as VeroClear®, to result in printable feedstock with Shore hardness values approximately in the range of about 27A to about 95A. Likewise, many different materials can be used as sacrificial materials, including but not limited to FullCure® 705.

The material that can be used for the plates 14, 16 can be the same as used for the portions of the pump 10 in which the compression chamber 20 and valves 60, 62 are disposed. The plates 14, 16 can be fabricated with the pump 10, or fabricated separately. In either instance, the plates 14, 16 can alternatively be made of different materials (or combinations thereof). For example, in some embodiments, the top plate 16 can be an aluminum plate and the bottom plate 14 can be an acrylic plate. The use of acrylic can allow the extent of displacement of the piston 24 to be observed as a supply pressure is varied to optimize the stroke. The plates 14, 16 can held against the pump 10 by fittings, such as nuts and bolts (visible in FIG. 6), which in turn can hold portions of the pump 10 itself together. Pumps of the nature provided for herein may need to be compressed to operate properly and/or preferably (e.g., without leakage), and thus the plates 14, 16 can provide compression to prevent leakage at the plate/pump interfaces. The amount of compression can be approximately in the range of about one percent to about ninety percent, more approximately in the range of about one percent to about fifty percent, and in the illustrated embodiment of FIG. 6 it is about seventeen percent (approximately 4 millimeters). The fittings can likewise be used to attach the pump 10 to other components of a system, such as those described below or otherwise derivable from the present disclosures.

A size of the miniaturized diaphragm pump 10 can depend on a variety of factors, including but not limited to the components with which it is being used, its intended use, and the preferences of the user. The illustrated embodiment provides for a pump 10 (sans-plates) that has a width W that is approximately 24 millimeters (as shown, into the page), a length L that is approximately 35 millimeters (as shown, a width of the page), and a height H that is approximately 24 millimeters (as shown, a length of the page), with a total pumping volume of about 1 $cm^3$ and approximately a five percent dead volume. More generally, miniaturized diaphragm pumps can have a width approximately in the range of about 10 millimeters to about 100 centimeters, a length approximately in the range of about 10 millimeters to about 200 centimeters, and a height approximately in the range of about 10 millimeters to about 100 centimeters.

The compression chamber 20 in the illustrated embodiment can include a 12.8 millimeter piston 24 surrounded by a one millimeter thick diaphragm 22, and each valve 60, 62 can be a four millimeter diameter piston surrounded by a one millimeter thick membrane 70, 72. The second surface **20*b* of the compression chamber 20 in the illustrated embodiment can be approximately 20 millimeters in diameter. More generally, the compression chamber 20 can include a piston 24 approximately in the range of about 0.1 millimeters to about 50 centimeters, the surrounding diaphragm 22 can have a thickness approximately in the range of about 0.1 millimeters thick to about 2.0 millimeters, and the second surface 20*b*** can have a diameter approximately in the range of about 5 millimeters to about 100 centimeters.

Additive Manufacture of a Single-Stage Miniaturized Diaphragm Pumps

The single-stage diaphragm pump 10, inclusive or exclusive of the plates 14, 16, can be printed using a variety of three-dimensional printing techniques. In the present disclosure, the focus is on polyjet printing, but a person skilled in the art will realize other techniques, including but not limited to fused filament formation and digital light processing stereolithography, can be utilized to produce pumps, components, and the like without departing from the spirit of the present disclosure. By using a layer-by-layer additive manufacturing technique, the present disclosure provides for significant improvements in how to fabricate pumps, and the performance of such fabricated pumps. Some of the benefits include the ability to perform rapid prototyping, device customization (e.g., component specific materials, and even within a component, specific properties resulting from various materials usages and configurations), and the ability to define various freeform geometries, while attaining minimum feature sizes on par with microfluidic systems (i.e., typical layer height is approximately in the range of about 5 μm to about 300 μm with a typical XY voxel size approximately in the range of about 5 μm to about 500 μm). The present disclosures do allow for smaller and larger feature sizes as desired. Further, the present additive manufacturing techniques also make possible leak-tight, closed channels or cavities. For example, larger compression chamber displacements are achievable in view of the present disclosures as compared to standard microfabrication techniques, thus allowing for better vacuum generation and larger flow rates. Still further, additive manufacturing provides for accurate vertical resolution, more so than existing techniques for fabricating miniaturized diaphragm pumps. Maintaining intended vertical resolution allows for the mechanical performance and leak rates achieved by the pumps of the present disclosure.

Turning to the polyjet printing techniques, polyjet printing creates layer-by-layer freeform solids by UV curing droplets of liquid photopolymer that are jetted on a build tray. Many different sizes, types, and configurations of polyjet printers can be utilized to fabricate the objects of the present disclosure. By way of non-limiting example, one or more voxels can be used to perform polyjet printing. The voxels can have many different sizes, shapes, and configurations. For example, one or more voxels having a width of approximately 42 μm, a length of approximately 42 μm (sometimes referred to as a 42 μm×Y pixelation), and a height of approximately 16 μm or approximately 25 μm can be used. More generally, the voxels can have widths approximately in the range of about 1 μm to about 1 centimeter, lengths approximately in the range of about 1 μm to about 1 centimeter, and heights approximately in the range of about 1 μm to about 1 centimeter.

In use, a polyjet printer can be operated to deposit material onto a surface to produce the miniaturized diaphragm pump 10. This can begin by depositing at least one material (it could be more) onto a surface to form a first layer of the pump. Subsequently, at least one material (again, it could be more) can be deposited onto the first layer to form a second layer of the pump. The at least one material of the second layer can be the same as or different from the material(s) used on the first layer, and the material(s) can vary even during output of that particular layer. That is, when printing a single layer, the material used to print does not have to have the same make-up throughout the layer. The process can continued to be performed by depositing at least one material (yet again, it could be more) onto subsequent layers of the pump to form the complete miniaturized diaphragm pump 10. The complete miniaturized pump 10 can include any combination of the components provided for in the present disclosure, but in some embodiments, the complete miniaturized pump includes a compression chamber and at least one valve (e.g., one or more active valves, one or more passive valves), the at least one valve being configured to control fluid flow between the compression chamber and at least one port. Each of the compression chamber and the at least one valve can be formed by the deposited at least one material. Further, layers do not necessarily have to be printed consecutively. In some instances, it may be more efficient to print portions of some layers before completing an earlier-started layer, and then going back to complete the earlier-started layer.

As indicated above, the at least one material can be any number of materials, including at least two materials. The materials provided can have different flexibility properties, thus allowing for different components of the pump to have different flexibilities, even within the component itself. The resulting pump can include at least one component (e.g., the compression chamber, the at least one valve, etc.) that has some make-up of materials that is different from another of the components (e.g., the compression chamber, the at least one valve, etc.). Materials that can be used for printing are discussed above, e.g., flexible photo-definable polymer(s), such as TangoBlack® materials, including but not limited to TangoBlack Plus®. Depending on the type of additive manufacturing that is performed, other types of materials can be used as well, including but not limited to Ninjaflex, Cheetah, Armadillo, and Nylon for fused filament fabrication, and fsl3d, Formlabs' flexible resin, and Spot-A Materials' flexible resin for stereolithography. Additionally, various types of sacrificial materials can also be utilized as indicated above, including but not limited to FullCure® 705, PVA, ABS, PLA, some of which are better used in conjunction with fused filament fabrication.

In instances in which a sacrificial material is used to fill cavities, openings, and the like during the printing process and then designed to be subsequently removed to open the cavities, openings, and the like, the fabrication method can include removing the sacrificial material. More specifically, the sacrificial material cam be removed from the complete miniaturized diaphragm pump so that a void(s) disposed within the complete miniaturized diaphragm pump results from removal of the sacrificial material. Various materials can be used to assist in removing a sacrificial material(s), including but not limited to a solution of 2% NaOH in $H_2O$ in conjunction with mechanical agitation. Thus, removing the sacrificial material(s) can include applying a solution designed to react with the sacrificial material(s) to allow it to be removed, which can also include providing some form of mechanical agitation (e.g., a brush, shaking, etc.) to work the solution through the pump to remove all of the sacrificial material(s).

One benefit of the presently provided techniques is that because any number of materials can be deposited by the printer to achieve different flexibilities and other desired parameters, materials that are deposited do not need to be later heated or cooled to adjust parameters such as flexibility. In existing systems, materials can often be reflowed or otherwise have the physical state of the material (e.g., liquid, solid, other quasi-states falling therebetween) changed to achieve different flexibilities and the like. Changing a physical state of the material is unnecessary when performing the additive manufacturing techniques taught herein.

Additional benefits of the fabrication techniques provided are described above with respect to the properties of the complete miniaturized diaphragm pump. Descriptions related to the a dead volume, a total pumping volume, a stroke length, a flow rate, a pressure ratio, a and base pressure can be achieved as a result of the provided for fabrication techniques.

As discussed above, in some instances, it can be beneficial to print the complete miniaturized diaphragm pump in portions or blocks. For example, perhaps it is desirable to use one material (or combination of materials) for a first portion of the pump and a second material (or combination of materials) for a second portion of the pump. In such instances, the piston block 17 can be fabricated using the first material(s) and the valve block 18 can be fabricated using the second material(s). If additional blocks are used, additional material(s) and combinations thereof can be utilized to print each block. Portions of the blocks that will be mated to other portions can be printed to include an adhesive to assist in creating a seal between the blocks when they are mated. A person skilled in the art will recognize other techniques that can be used to mate or otherwise couple two components while maintaining a seal therebetween. Generally the seal should be vacuum-tight. As illustrated herein, the plates help provide a vacuum seal by compressing the piston block 17 and the valve block 18 together.

During the course of fabricating pumps of the present disclosure, steps can be taken to tune the pump. For example, the at least one valve as described can be, as shown, a vacuum valve 60 and an exhaust valve 62. The vacuum valve 60 can be configured to control a flow of fluid from a vacuum port 40 and to the compression chamber 20, and the exhaust valve 62 can be configured to control a flow of fluid from the compression chamber 20 to the exhaust port 42. Tuning can then include selectively opening and closing the two valves 60, 62. By way of non-limiting example, in one instance the vacuum valve 60 can be closed and the exhaust valve 62 opened. The compression chamber 20 can then be actuated to advance fluid from the compression chamber 20 and into the exhaust port 42. As described above, actuation of the compression chamber 20 can be achieved by drawing the piston 24 towards the diaphragm 22 and compression chamber 20 to create an exhaust force. The exhaust valve 62 can then be closed and the vacuum valve 60 opened. Again the compression chamber 20 can be actuated, but this time to advance fluid from the vacuum port 40 and into the compression chamber 20. As described above, actuation of the compression chamber 20 can be achieved by drawing the piston 24 away from the diaphragm 22 and compression chamber 20 to create a vacuum force.

Based on various parameters of the pump 10 that are measured, such as a frequency of the piston 24, the time it takes the valves 60, 62 to open and close, and the time it takes the piston 24 to advance towards the compression chamber 20 (up) and away from the compression chamber 20 (down), adjustments to the pump 10 can be made. For example, at least one of a time it takes for the vacuum valve 60 to open, a time it takes for the exhaust valve 62 to open, a time it takes for the vacuum valve 60 to close, a time it takes for the exhaust valve 62 to close, a pressure at which fluid flows through the vacuum valve 60, and a pressure at which fluid flows through the exhaust valve 62 can be adjusted based on parameters measured during the tuning process. These steps can be repeated, re-ordered, and used as many times as desired to tune the pump 10. One example of valve and piston timings that were recorded during a tuning process are provided by the following Table 1:

| Frequency (Hz) | Vacuum Valve Close, Exhaust Valve Open (ms) | Piston Up (ms) | Exhaust Valve Close, Vacuum Valve Open (ms) | Piston Down (ms) |
|---|---|---|---|---|
| 1.82 | 2, 10 | 263 | 2, 10 | 263 |
| 2.13 | 2, 10 | 223 | 2, 10 | 23 |
| 3.23 | 2, 10 | 143 | 2, 10 | 143 |
| 5.26 | 2, 10 | 83 | 2, 10 | 83 |

More specifically, the pumping performance can be optimized by adjusting the timing of the valves 60, 62 and, in instances in which a pneumatic actuator is used to actuate the valves 60, 62 (as described both above and below), $N_2$ pressure. The above table illustrates the sequencing and delay times used in conjunction with the system described below with respect to FIG. 6. A Dataq DI-149 datalogger collected voltage signals from a pressure transducer at a rate of 8 Hz. The piston 24 and valves 60, 62 were activated pneumatically with pressurized nitrogen regulated to 15 psig and a vacuum supplied by an Edwards nXDS15i connected to the actuators (e.g., three-way solenoid valves). When an actuator is switched to either pressurized nitrogen or supplied vacuum, the valves 60, 62 and piston 24 are either pushed forward or pulsed back. Time between switching depends upon actuation frequency. Operating the pump 10 at low frequencies (e.g., 1.82 Hz, 275 ms) results in much more time between switching compared to operating at high frequencies (e.g., 5.26 Hz, 95 ms), which allows more time for pressure to build or supply vacuum pressure to drop behind the membranes being actuated. This can result in less than full displacement of the compression chamber diaphragm 22 at higher actuation frequencies and hence higher base pressures.

Other steps can be performed during the manufacturing process to improve the performance and longevity of the pump. By way of non-limiting example, one or more films can be deposited on the outermost surface of any of the components of the pump 10 to increase the chemical resiliency of the pump 10. This includes, but is not limited to, the outermost surface of the housing 12 of the pump, the outermost surface of the compression chamber 20, the outermost surface of the fluid port(s) 40, 42, and the outermost surface of the valve(s) 60, 62.

Systems that Incorporate One or More Miniaturized Diaphragm Pumps

Figure 6:
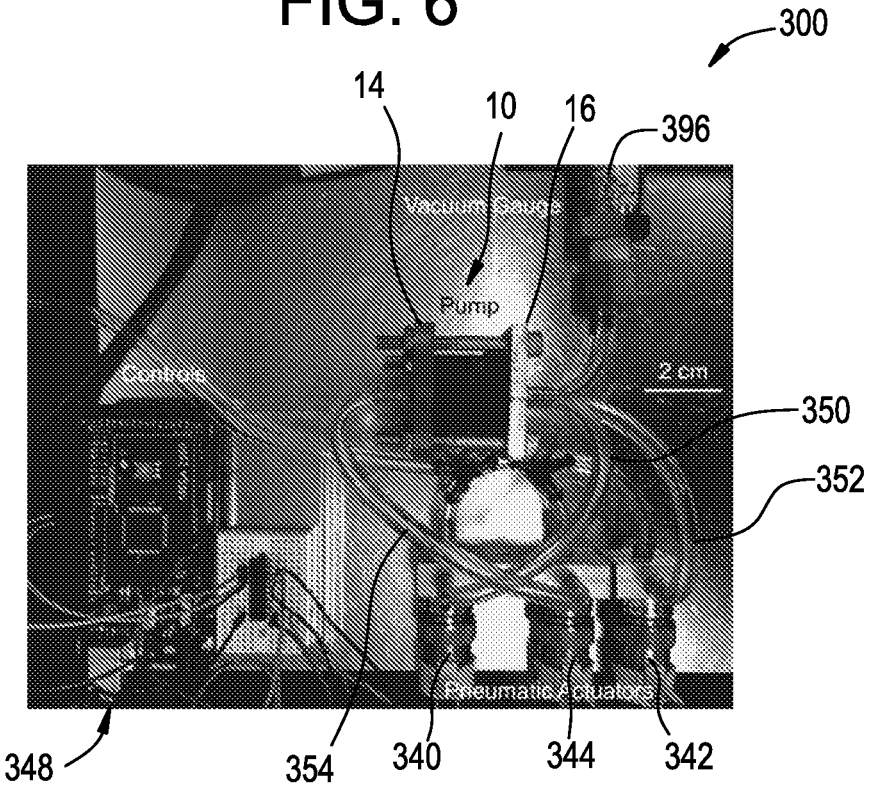
FIG. 6 is a side view of one exemplary embodiment of a system that includes a miniaturized vacuum pump.

FIG. 6 provides for the pump 10 being incorporated into a system 300. The set-up of the plates 14, 16 with respect to the pump 10 is described above, as are the various port configurations for interactions with other components, such as brass fittings. The system includes a plurality of actuators, as shown a first pneumatic actuator 340, a second pneumatic actuator 342, and a third pneumatic actuator 344, as well as a vacuum gauge 346. A controller 348 is also provided, with the controller 348 being configured to operate the actuators 340, 342, 344 and gauge 346 to selectively activate the portions of the pump 10 with which the actuators and gauges are associated.

As shown, the first and second pneumatic actuators 340, 342 are in communication with the first and second valves 60, 62 (not easily visible) by way of first and second actuator tubes 350, 352 extending therebetween. As a result, the actuators 340, 342 can be operated to selectively open and close the first and second valves 60, 62. More specifically, in the illustrated embodiments, the first pneumatic actuator 340 can be configured to open the first valve 60 to allow fluid to flow from the vacuum port 40 (not easily visible) and into the compression chamber 20 (not easily visible) by way of a vacuum force provided by the piston 24 (not easily visible), and to close the first valve 60 to prevent such fluid flow in response to movement by the piston 24. In particular, the pump 10 creates vacuum by removing pockets of gas from a cavity (e.g., the vacuum port and/or a chamber connected to the vacuum port), compressing them in a closed space (e.g., the compression chamber), and releasing them to a reservoir at a higher pressure (e.g., the exhaust port and/or the volume connected to the exhaust port and/or the exterior of the pump at atmospheric pressure) at atmospheric pressure. Likewise, the second pneumatic actuator 342 can be configured to open the second valve 62 to allow fluid to flow from the compression chamber 20 to the exhaust port 42 (not easily visible) by way of an exhaust force provided by the piston 24, and to close the valve 62 to prevent such fluid flow in response to movement by the piston 24. Generally during fluid flow, one of the valves 60, 62 is open while the other is closed. The third actuator 344 can provide the movement of the piston 24 by selectively driving the piston 24 towards and away from the compression chamber 20 to provide the exhaust force and the vacuum force, respectively. The third actuator 344 can be connected to the port 78 (not easily visible) by way of third tube 354 extending therebetween.

One non-limiting example of pneumatic actuators that can be used in conjunction with the present disclosure is a three-way solenoid valve, such as the Clippard model EC-3M-12-H solenoid valves. These valves have a response time of approximately 10 milliseconds and can be used for valve and diaphragm pneumatic operation. Compressed nitrogen ($N_2$) can be fed to one side of the valves, a house vacuum to the other side, and ⅛" Tygon tubing can be plumbed from barbed fittings on the plates to the solenoid valves. The $N_2$ supply pressure can then be regulated to control opening and closing the valve and the stroke of the piston for the respective actuators.

In alternative embodiments, the pneumatic actuators 340, 342, 344 can be replaced with electromagnetic actuators, with the electromagnetic actuators being configured to control the valves and pistons in a similar manner. A person skilled in the art will recognize how electromagnetic actuators operate, and thus a description of the same is unnecessary. Further, other forms of actuators provided for herein (e.g., mechanical, electro-mechanical, piezo-electric, thermal (bimetallic), electrostatic, and fluid) or otherwise known to those skilled in the art can be used in lieu of or in combination with the pneumatic and/or electromagnetic actuators.

The controller 348 can be operated to control operation of the various components of the system, such as the pneumatic actuators 340, 342, 344, to selectively operate the piston 24 and/or control the flow of fluid in the pump 10. In the illustrated embodiment, the controller 348 is an Arudino micro controller (Mega 2560), although many other controllers can be used in lieu of or in addition to the illustrated micro controller. As shown, the controller 348 is programmed to supply pressurized $N_2$ or house vacuum to the pump valves 60, 62 and the diaphragm 22. The pumping performance can be optimized by adjusting the timing of the valves and $N_2$ pressure. A person skilled in the art, in view of the present disclosures, will understand how the optimization can be performed. During pump testing, a datalogger, such as a Dataq DI-149 datalogger, can be used to collect voltage signals from a pressure transducer associated with the system at a rate of about 8 Hz. The pistons and valves can be activated pneumatically with pressurized nitrogen regulated to about 11 psi and house vacuum of about 270 Torr (about 9.5 psi).

The vacuum gauge 346 can be operated to measure an amount of pressure that exists after the vacuum has been created in the pump 10. This can help determine if a desired pressure-level has been achieved to allow the pump 10 to operate as desired. Other techniques for measuring an amount of pressure can also be used. Alternatively, or additionally, the controller 348 can be operated to measure various parameters of the pump 10 and/or the system 300. A person skilled in the art will understand how to operate the controller 348 to manage various parameters of the pumps and systems provided for herein, or such pumps and systems that are derivable from the present disclosures.

In operation, the illustrated system 300 demonstrated that while having the piston 24 operated at a frequency of about 3.27 Hz, the pump 10 consistently pumped down from atmospheric pressure to about 330 Torr in under 50 seconds, thus giving it an effective flow rate of about 8.7 $cm^3$ per minute, which is greater than 300 times higher than flow rages from diaphragm vacuum pumps manufactured using standard microfabrication techniques. In another operation, the illustrated system 300 demonstrated that while having the piston 24 operated at a frequency of about 1.82 Hz, the pump 10 consistently pumped down from atmospheric pressure to 110 Torr in under four seconds, which is the smaller and faster than any known microfabricated diaphragm vacuum pump. Further, the systems demonstrated that the pumps 10 can deliver mass flow rates as high as 200 standard cubic centimeters per minute at about 535 Torr, which is much higher than flow rates for a diaphragm vacuum pump manufactured with standard microfabrication techniques. Still further, the compression chamber diaphragms 22 exhibited lifetimes approaching one million cycles, while the valves did not leak after over two million cycles.

More generally, a flow rate of the pumps provided for herein generally can be greater than about 4.0 standard cubic centimeters per minute. A pressure ratio of the pumps provided for herein generally can be greater than approximately 4.75, where the pressure ratio is the ratio between the exhaust pressure (in principle atmospheric pressure) and the base pressure of the pump. The pressure ratio is also equal to the ratio of the pump volume to the dead volume. A base pressure of the pumps provided for herein generally can be less than about 160 Torr.

Figure 7:
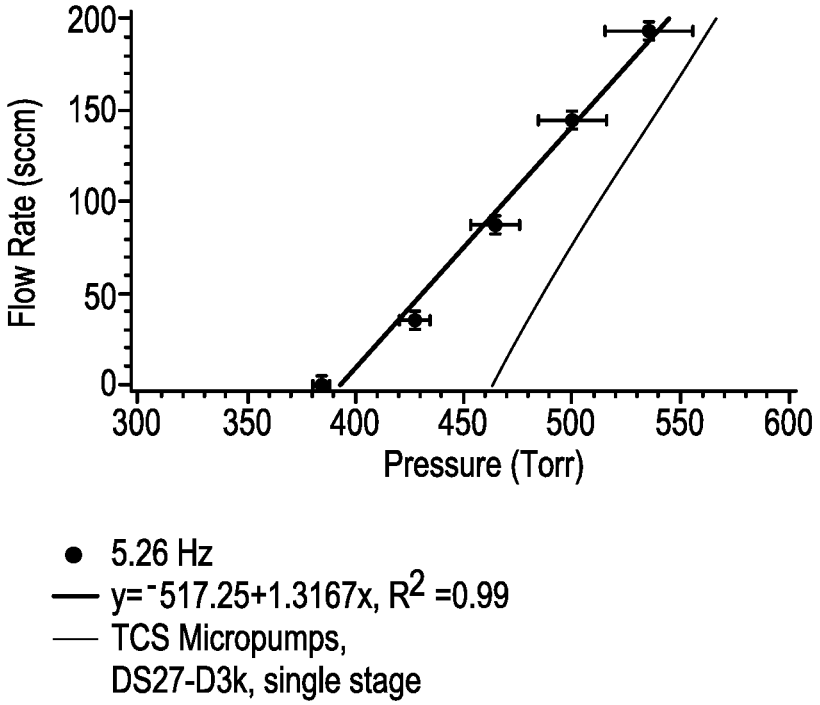
FIG. 7 is a graph illustrating a relationship between flow rate and pressure for one exemplary embodiment of a miniaturized vacuum pump in accordance with the present disclosures compared to a relationship between flow rate and pressure for a miniaturized vacuum pump produced by way of microfabrication.

FIG. 7 is a graph that compares a flow rate vs. a pressure for both the present pump operated at 5.26 Hz and a single-stage diaphragm pump from TSC Micropumps, model DS27-D2 k. The data was collected with a pump and a piston that includes a layer height of about 25 μm, a pump width of about 24 mm, a diaphragm thickness of about 1 mm, and a hardness of about 27A shore. As shown, a flow rate of the present pump can be achieved at lower pressures than with the TSC Micropumps pump. As pressures increase, this difference is not as pronounce, but nevertheless, the improved performance is clear. Each data point in the plot is an average of about 200 pressure readings at each flow rate, the error bars on the pressure represent one standard deviation, and on the flow rate+/−5 standard cubic centimeters per minute. A representative result is a nitrogen flow rate of 200 standard cubic centimeters per minute at 535 Torr, which is significantly higher than those of microfabricated diaphragm vacuum pumps, and higher than those for commercially available diaphragm pumps of comparable dimensions made with standard manufacturing, like the TSC Micropumps pump.

The pumps provided for herein can also be operated as part of a pump system. That is multiple pumps can be coupled together to further improve their performance and use in various contexts. In some instances, at least one pump configured in accordance with the present disclosures (e.g., the pump 10) can be coupled in series to one or more other pumps configured in accordance with the present disclosures. Likewise, in some instances, at least one pump configured in accordance with the present disclosures (e.g., the pump 10) can be coupled in parallel to one or more other pumps configured in accordance with the present disclosures. The one or more other pumps used in conjunction with one of the pumps of the present disclosure can be configured in manners outside of the scope of the present disclosures without departing from the spirit of the present disclosures. When coupling in series, the pumping system can achieve lower base pressure and when coupling in parallel, which can be useful, for example, to reach a lower base pressure that can enable a process that would otherwise be unfeasible. The pumping system can achieve higher throughput (i.e., flow rate at a given pressure), which can be useful, for example, to increase the throughput in a reactor.

One skilled in the art will appreciate further features and advantages of the disclosure based on the above-described embodiments. Accordingly, the disclosure is not to be limited by what has been particularly shown and described, except as indicated by the appended claims. All publications and references cited herein are expressly incorporated herein by reference in their entirety.

What is claimed is:

1. A diaphragm pump, comprising:

a compression chamber defined by a first surface, a second surface opposed to the first surface, and a conical outer wall extending between the first surface and the second surface, the conical outer wall having a bowed configuration in which the outer wall has a generally concave shape;

a first fluid port;

a second fluid port;

a first valve disposed more proximate to the first surface than the second surface of the compression chamber and in fluid communication with the compression chamber and the first fluid port;

a second valve disposed more proximate to the first surface than the second surface of the compression chamber and in fluid communication with the compression chamber and the second fluid port;

a diaphragm disposed more proximate to the second surface than the first surface of the compression chamber and configured to actuate the compression chamber, wherein the first valve and the second valve are configured such that one valve of the first and second valves is closed while the other valve is open to allow fluid to flow from the respective first or second fluid port and into the compression chamber by way of a vacuum force, and the other valve is closed while the one valve is open to allow fluid to flow from the compression chamber and into the respective first or second fluid port by way of an exhaust force.

2. The diaphragm pump of claim 1, further comprising a piston configured to engage the diaphragm to actuate the compression chamber.

3. The diaphragm pump of claim 1, further comprising one or more pneumatic actuators, the one or more pneumatic actuators being configured to selectively operate the first and second valves to control fluid flow therethrough.

4. The diaphragm pump of claim 1, further comprising one or more electromagnetic actuators, the one or more electromagnetic actuators being configured to selectively operate the first and second valves to control fluid flow therethrough.

5. The diaphragm pump of claim 1, wherein each of the compression chamber, the first fluid port, the second fluid port, the first valve, the second valve, and the diaphragm comprise a flexible photo-definable polymer.

6. The diaphragm pump of claim 5, wherein the flexible photo-definable polymer comprises one or more materials comprising at least one of the following properties: a Young's modulus equal to about 0.3 MPA, a tensile strength equal to about 0.8 MPa, or a Shore hardness value approximately in the range of about 27A to about 95A.

7. The diaphragm pump of claim 1, wherein a dead volume of the compression chamber is approximately five percent or less.

8. A multi-stage diaphragm pump system, comprising:

a first diaphragm pump of claim 1 coupled in series to at least one additional diaphragm pump of claim 1.

9. A multi-stage diaphragm pump system, comprising:

a first diaphragm pump of claim 1 coupled in parallel to at least one additional diaphragm pump of claim 1.

10. The diaphragm pump of claim 1, wherein the compression chamber outer wall having the generally concave shape has a positive radius of curvature.

11. The diaphragm pump of claim 1, wherein the generally concave shape of the outer wall minimizes a dead volume of the compression chamber.

12. The diaphragm pump of claim 7, wherein the pump is configured to achieve a flow rate of greater than about 4.0 standard cubic centimeters per minute.

13. A diaphragm pump, comprising:

a compression chamber defined by a first surface, a second surface opposed to the first surface, and a conical outer wall extending between the first surface and the second surface, the conical outer wall having a bowed configuration in which the outer wall has a generally concave shape;

a first fluid port;

a second fluid port;

a first valve disposed more proximate to the first surface than the second surface of the compression chamber and in fluid communication with the compression chamber and the first fluid port;

a second valve disposed more proximate to the first surface than the second surface of the compression chamber and in fluid communication with the compression chamber and the second fluid port;

a diaphragm disposed more proximate to the second surface than the first surface of the compression chamber and configured to actuate the compression chamber;

a piston configured to engage the diaphragm to actuate the compression chamber;

a piston block that includes the compression chamber and a first portion of each of the first and second valves; and a valve block that includes the first and second fluid ports and a second portion of each of the first and second valves, wherein the first valve and the second valve are configured such that one valve of the first and second valves is closed while the other valve is open to allow fluid to flow from the respective first or second fluid port and into the compression chamber by way of a vacuum force, and the other valve is closed while the one valve is open to allow fluid to flow from the compression chamber and into the respective first or second fluid port by way of an exhaust force, wherein each of the piston block and the valve block are monolithically formed and are coupled together by way of a vacuum-tight seal.

14. The diaphragm pump of claim 13, wherein the compression chamber outer wall having the generally concave shape has a positive radius of curvature.

15. The diaphragm pump of claim 13, wherein the generally concave shape of the outer wall minimizes a dead volume of the compression chamber.

16. The diaphragm pump of claim 13, wherein a dead volume of the compression chamber is approximately five percent or less.

17. The diaphragm pump of claim 16, wherein the pump is configured to achieve a flow rate of greater than about 4.0 standard cubic centimeters per minute.

18. The diaphragm pump of claim 13, wherein each of the compression chamber, the first fluid port, the second fluid port, the first valve, the second valve, and the diaphragm comprise a flexible photo-definable polymer.

19. The diaphragm pump of claim 18, wherein the flexible photo-definable polymer comprises one or more materials comprising at least one of the following properties: a Young's modulus equal to about 0.3 MPA, a tensile strength equal to about 0.8 MPa, or a Shore hardness value approximately in the range of about 27A to about 95A.

20. The diaphragm pump of claim 13, further comprising at least one of:

one or more pneumatic actuators, the one or more pneumatic actuators being configured to selectively operate the first and second valves to control fluid flow therethrough; or one or more electromagnetic actuators, the one or more electromagnetic actuators being configured to selectively operate the first and second valves to control fluid flow therethrough.

* * * * *